US007090219B2

(12) United States Patent
Schrefl et al.

(10) Patent No.: US 7,090,219 B2
(45) Date of Patent: Aug. 15, 2006

(54) SEALING DEVICE

(75) Inventors: Herbert Schrefl, St. Poelten (AT); Rüdiger Keinberger, Aigen (AT); Valentin Weiss, St. Georgen (AT); Anton Luger, Sarleinsbach (AT)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/624,605

(22) Filed: Jul. 23, 2003

(65) Prior Publication Data

US 2004/0195779 A1 Oct. 7, 2004

Related U.S. Application Data

(63) Continuation of application No. 10/090,172, filed on Mar. 5, 2002, now abandoned.

(30) Foreign Application Priority Data

Mar. 7, 2001 (DE) ..... 101 10 946

(51) Int. Cl.
*F16J 15/46* (2006.01)

(52) U.S. Cl. ..... 277/345; 277/580; 277/583; 162/371

(58) Field of Classification Search ..... 277/345, 277/503, 505, 578–580, 903, 906; 162/367–371, 162/363

See application file for complete search history.

(56) References Cited

U.S. PATENT DOCUMENTS

| | | | | |
|---|---|---|---|---|
| 2,274,641 A | | 3/1942 | Abbott et al. | |
| 2,312,519 A | | 3/1943 | Berry | |
| 2,578,551 A | | 12/1951 | Hornbostel | |
| 2,893,487 A | | 7/1959 | Dahl et al. | |
| 2,900,024 A | | 8/1959 | Holcroft | |
| 3,586,342 A | | 6/1971 | Staab | |
| 4,295,654 A | | 10/1981 | Kawamura et al. | |
| 4,560,174 A | | 12/1985 | Bisi | |
| 4,783,085 A | * | 11/1988 | Wicks et al. | 277/345 |
| 4,915,787 A | | 4/1990 | Branyon et al. | |
| 5,141,238 A | * | 8/1992 | Brendel | 277/345 |
| 5,262,010 A | | 11/1993 | Bubik et al. | |
| 5,556,112 A | * | 9/1996 | Brandt | 277/560 |
| 5,580,424 A | | 12/1996 | Snellman | |
| 6,050,575 A | | 4/2000 | Balsells et al. | |
| 6,302,399 B1 | | 10/2001 | Prinzing | |
| 6,436,241 B1 | | 8/2002 | Persson et al. | |

FOREIGN PATENT DOCUMENTS

| | | |
|---|---|---|
| DE | 19751283 | 5/1999 |
| GB | 736149 | 9/1955 |

* cited by examiner

*Primary Examiner*—Vishal Patel
(74) *Attorney, Agent, or Firm*—Greenblum & Bernstein, P.L.C.

(57) ABSTRACT

Sealing device for sealing at least one zone of underpressure or overpressure adjoining a moving surface that includes at least one sealing element, positionable opposite the moving surface to form a front and a rear, with respect to a surface running direction. The sealing device includes a sealing section located at the front and a ventilation section located at the rear. The sealing section is structured to sealingly interact with the moving surface; and the ventilation section is structured and arranged to form a gap with the moving surface that widens in the surface running direction.

20 Claims, 6 Drawing Sheets

S1/S2/Sn AS MANY SUCTION ZONES AS DESIRED

SEALING DEVICE

CROSS-REFERENCE TO RELATED APPLICATIONS

The present application is a continuation of U.S. patent application Ser. No. 10/090,172 filed Mar. 5, 2002 is now Abandonment and that claims priority under 35 U.S.C. § 119 of German Patent Application No. 101 10 946.6 filed Mar. 7, 2001, the disclosures of which are expressly incorporated by reference herein in their entireties.

BACKGROUND OF THE INVENTION

1. Field of the Invention

The invention relates to a sealing device for the sealing of at least one zone of underpressure or overpressure adjoining a moved surface in a paper making machine. The sealing device includes at least one sealing element disposed opposite the moved surface. Such a sealing device is known, e.g., from DE-A-197 51 283 (see FIG. 15).

2. Discussion of Background Information

Such sealing devices are used in practice both in the former part and in the press part and/or the dryer part of a respective paper machine, where they can be used in, among other things, suction rolls or blow rolls. For instance, as a rule, suction rolls have fixed interior suction boxes which form, e.g., adjustable zones having at least one pressure level, with the sealing of the pressure zones or vacuum zones taking place in the wire travel direction by sealing strips, which as a rule extend at least substantially over the whole roll length.

As a rule, sealing strips having a continuous straight runoff edge are used for sealing the vacuum in suction roll types. However, the vacuum in the roll perforation breaks down abruptly at such a runoff edge of the sealing strip running off in the wire travel direction, which produces an extremely high development of noise and results in a clearly audible, shrill so-called "suction roll whistle".

SUMMARY OF THE INVENTION

According to the present invention, a sealing device of the kind generally discussed above is provided in which the noise development is reduced to a minimum or even completely eliminated. In accordance with the invention, a sealing device for the sealing of at least one zone of underpressure or overpressure adjoining a moved surface in a paper making machine includes at least one sealing element disposed opposite the moved surface. The at least one sealing element includes a sealing section, which sealingly interacts with the moved surface and which is at a front of the sealing element, when viewed in a running direction of the moved surface, and a ventilation element adjoining the sealing section, which is at a rear of the sealing element, when viewed in the running direction. The ventilation element is provided with a plurality of teeth extending in the running direction at a surface facing the moved surface that are arranged next to each other, and with grooves formed between the teeth that open toward the end at the rear with a continuously expanding cross-section in the running direction, whereby a running off edge results at the rear end of the ventilation section which is substantially of saw tooth or wavy shape.

The openings provided in the respective moved surface are not exposed abruptly, but continuously, so that a continuous pressure compensation or pressure reduction takes place in these openings. The noise development is accordingly reduced to a minimum or even completely eliminated. In the case of a suction roll, the occurrence of the so-called suction roll whistling is thus at least reduced.

The teeth can each have a continuously narrowing toothed crest in the running direction of the moved surface.

In a preferred practical embodiment of the sealing device in accordance with the invention, the width of a respective toothed crest is smaller than the opening diameter in the region of the running off edge. The tooth flanks can have the same inclination or also become continuously steeper in the running direction of the moved surface.

The groove depths preferably increase continuously in the running direction of the moved surface. The cross-sections of the grooves can in particular be V shaped.

The rear ventilation section can be composed of the same material as the front sealing section and preferably can be made in one piece. In accordance with an advantageous alternative embodiment, the ventilation section can, however, be composed of a different material than that of the sealing section and, preferably, these two sections can be made separately from each other and secured together. The ventilating section can advantageously be composed a porous sound-absorbing plastic, whereby the noise level is even further reduced.

At least the sealing section of the sealing element can consist, for example, of rubber graphite, polyethylene (PE) such as in particular thermoplastic UHMW, thermosetting plastic such as in particular phenolic resin and/or the like. The sealing element can in particular include a sealing strip which preferably extends transversely to the running direction of the moved surface.

In accordance with a further aspect of the invention, a sealing device for the sealing of at least one zone of underpressure or overpressure adjacent to a moved surface in a paper making machine includes at least a sealing element which is disposed opposite the moved surface and is pivotally mounted. The sealing element, which includes a sealing section located at a front of the sealing element, when viewed in a running direction of the moved surface, and a ventilation section adjoining the sealing section and located at a rear of the sealing element, when viewed in the running direction, can be pivoted to achieve the sealing function in an operating position in which the sealing section sealingly contacts the moved surface. In the operating position, the sealing element is structured so that a gap remains between the ventilating section and the moved surface.

Due to this design, the openings provided in the respective moved surface are not exposed abruptly, but continuously, so that a continuous pressure compensation or pressure reduction takes place in these openings. Accordingly, the noise development is reduced to a minimum or even completely eliminated. In the case of a suction roll, the occurrence of the so-called "suction roll whistling" is at least reduced. Moreover, an advantage results with respect to the previously recited solution with teeth of an even clearer noise reduction at higher speeds. In contrast to the toothed version or crest version, a ventilation of suction openings or suction orifices occurs, e.g., over the total width in the present case so that lacks in constancy are excluded in the reduction of the vacuum.

Although teeth are not required in this particular embodiment, it is contemplated that the toothed arrangement of the ventilation section can be utilized in combination with the embodiment in which a gap is maintained between the ventilation section and the moved surface.

In a preferred practical embodiment, the sealing element can be pivoted about an axis extending transversely to the running direction of the moved surface. The sealing element can be pivotally mounted in the region of the ventilation section. The sealing element is advantageously pivotally mounted in the region of its end which is at the rear, when viewed in the running direction of the moved surface, preferably in the region of its rear end face. The pivot mounting can in particular be formed by a rocker bearing.

In an expedient practical embodiment, the pivot mounting includes a fixed bearing element which engages into a groove of the sealing element.

A preferred practical embodiment of the invention includes a groove arranged at a rear end face of the sealing element and a fixed guide surface provided in a region of the front end face of the sealing element which admittedly allows a pivot movement of the sealing element, but which prevents the sealing element from moving away from the fixed bearing element so as to maintain the pivot bearing. In this regard, the end face of the sealing element at the front considered in the pivot plane can in particular be curved. The fixed guide surface can be planar or curved.

It is also of advantage for the gap to expand in the running direction of the moved surface. The gap can thus be kept relatively narrow, with it nevertheless being ensured that the sealing edge which is at the rear considered in the running direction is substantially offset from the moved surface. The sealing element can, for example, have a reducing thickness in the running direction of the moved surface.

In an expedient practical embodiment, the sealing element can be loaded in its operating position by a pressure device, preferably at least one pressure hose and/or the like.

The sealing element can, during operation, be permanently loadable into its operating position by, e.g., the pressure device. However, it is generally also possible for the sealing element to be held in its respective operating position by, e.g., friction clamping. In the latter case, the pressure device does not have to be permanently activated. It is sufficient if the sealing element is moved or readjusted into the operating position by the pressure device. It can then be held in the respective operating position, e.g., by the friction clamping produced. Such a friction clamping is, however, not mandatory.

In a preferred practical embodiment, the sealing element can be correspondingly readjusted by the pressure device in the event of respective wear of the front sealing section adjoining the moved surface. Such a readjustment can in particular take place automatically as is the case, e.g., with a permanent loading of the sealing element. The sealing element can advantageously be subjected to the action of the pressure device in the region of the front sealing section.

It is also of advantage for the pressure device to be arranged at the side of the sealing element remote from the moved surface. The sealing element can, e.g., including a lug that preferably extends in the pivot direction, with the lug being exposed to action by the pressure device.

The force transmission from the pressure device to the sealing element can take place, e.g., via a spacer. Such a spacer can in particular serve for the protection of the pressure device. The spacer can have especially designed counter surfaces. For instance, the spacer can, e.g., be cambered at the side facing the pressure device and/or the side facing the sealing element.

It is also of advantage for the spacer to be guided, e.g., in a guide in a linear manner. Generally, however, a direct force transmission from the pressure device to the sealing element is also possible. In this case, therefore, the spacer is omitted.

In an expedient practical embodiment, the sealing element can be charged with a cleansing agent via at least one rinsing line or the like, with the sealing element being chargeable with cleansing agent permanently or only from time to time during operation. In the latter case, e.g., a periodical charging with cleansing agent is possible. Such a rinsing line is, however, not mandatory, but only to be considered as an alternative possibility.

The sealing element can in particular again include a sealing strip which preferably extends transversely to the running direction of the moved surface.

As already mentioned, any desired combinations of the two solutions in accordance with the invention are also possible.

The respective sealing device can generally, e.g., be provided for sealing at least one pressure zone adjoining a rotating jacket of a suction roll or blow roll or a moved band such as in particular a transport band, a press band or the like, which can be a zone of underpressure or of overpressure. The sealing device can also be arranged in particular between pressure zones of different pressure levels, with one pressure zone, e.g., also being able to be under atmospheric pressure.

If the respective sealing device is provided for lateral sealing of at least one pressure zone provided at a rotating jacket of a suction roll or blow roll, the sealing element is preferably formed by a sealing strip extending at least substantially over the whole roll length. The respective sealing device can be provided, e.g., for sealing at least one inner pressure zone adjoining the inner wall of a rotating jacket of a suction roll or blow roll.

Generally, however, the use of the respective sealing device is also thinkable for sealing at least one outer pressure zone adjoining the outer wall of a rotating jacket of a suction roll or blow roll.

The respective sealing device can be provided with particular advantage for use between a suction box or blow box, and the rotating jacket of a suction roll or blow roll or a moved band.

The present invention is directed to a sealing device for sealing at least one zone of underpressure or overpressure adjoining a moving surface that includes at least one sealing element, positionable opposite the moving surface to form a front and a rear, with respect to a surface running direction, with a sealing section located at the front and a ventilation section located at the rear. The sealing section is structured to sealingly interact with the moving surface and the ventilation section is structured to contact the moving surface and includes a run off surface having at least one of a substantially sawtooth and wavy shape surface arranged at an end of the rear.

In accordance with a feature of the invention, the seating section can adjoin the ventilation section. The at least one of a substantially sawtooth and wavy shape surface may include a plurality of teeth extending in the running direction with grooves formed between adjacent teeth, and the grooves can be structured to flare open toward the end. The grooves are structured to continuously increase in cross-section toward the end. The moving surface can be arranged in a paper making machine. Further, each of the plurality of teeth may have a tooth crest that continuously narrows in the running direction. Moreover, a width of each respective tooth crest can be smaller, at the run off edge, than an orifice diameter in the moving surface. The grooves may have continuously increasing depths in the running direction. Still further, the grooves can include at least partly V-shaped cross-sections.

Further, the present invention is directed to a sealing device for sealing at least one zone of underpressure or overpressure adjoining a moving surface that includes at least one sealing element, positionable opposite the moving surface to form a front and a rear, with respect to a surface running direction. The sealing device includes a sealing section located at the front and a ventilation section located at the rear. The sealing section is structured to sealingly interact with the moving surface; and the ventilation section is structured and arranged to form a gap with the moving surface that widens in the surface running direction.

According to a feature of the invention, the sealing section can adjoin the ventilation section, and the ventilation section may be pivotably mounted. Further, the ventilation section can be structured to continuously decrease in cross-section away from the sealing section, and the moving surface may be arranged in a paper making machine. Moreover, the gap can have a continuously increasing depth in the surface running direction.

According to another feature of the instant invention, the sealing section and the ventilation section can be composed of a same material. Further, The sealing section and the ventilation section may be formed as a single piece.

According to still another feature of the present invention, the sealing section and the ventilation section may be composed of different materials. Further, the sealing section and the ventilation section can be separately formed and secured together.

In accordance with a further feature, the ventilation section can be composed of a porous sound-absorbing plastic.

The sealing section may be composed of at least one of rubber graphite, polyethylene, and thermosetting plastic. Further, the polyethylene can include thermoplastic UHMW and the thermosetting plastic may include phenolic resin.

Moreover, the sealing element may include a sealing strip. The sealing strip can extend transversely to the running direction.

The present invention is directed to a sealing device for sealing at least one zone of underpressure or overpressure adjoining a moved surface that includes at least one sealing element, positionable opposite the moving surface to form a front and a rear, with respect to a surface running direction, having a sealing section located at the front and a ventilation section located at the rear. The at least one sealing element is pivotably mounted to pivot relative to the moving surface to position the at least one sealing element into an operating position. In the operating position, the sealing section is in sealing contact with the moving surface and a gap is formed between the ventilation surface and the moving surface.

According to a feature of the invention, the sealing section can adjoin the ventilation section.

Further, the moving surface may be arranged within a paper making machine.

In accordance with another feature of the present invention, the sealing element can be pivotable about an axis extending transversely to the running direction.

According to still another feature, the sealing element may be pivotally mounted in a region of the ventilation section.

According to a still further feature of the invention, the sealing element may be pivotally mounted in a region of an end located at the rear.

In accordance with a further feature, the sealing element may be pivotally mounted in a region of an end face located at the rear.

The sealing device can further include a rocker bearing arranged pivotably mount the sealing element.

Further, the sealing element can include a groove, and the sealing device may further include a pivot bearing arranged to pivotably mount the sealing element. The pivot bearing may include a fixed bearing element arranged to engage the groove. The groove can be arranged at a rear end face located at the rear, and the sealing device may further include a fixed guide surface arranged in a region of a front end face of the sealing element. The fixed guide surface may be structured and arranged to permit the pivoting movement of the sealing element and to prevent the sealing element from moving away from the fixed bearing element, thereby maintaining the pivot bearing. The front end face can have a curved surface. Further, the fixed guide surface can be planar, or the fixed guide surface may be curved.

According to the invention, the gap can increase in the running direction.

In accordance with another feature, the sealing element may have a reducing thickness in the running direction.

The sealing device can further include a pressure device coupled to the sealing element, and the sealing element may be loadable into the operating position by the pressure device. Further, the pressure device can include a pressure hose.

The sealing device may further include a pressure device coupled to the sealing element, and the sealing element may be permanently loadable into the operating position by the pressure device during operation. The sealing element can be held in the operating position by friction clamping.

The sealing device can further include a pressure device coupled to the sealing element, and the sealing element may be positionally adjustable via the pressure device to compensate for wear of the sealing section.

The sealing device can further include a pressure device coupled to the sealing element, and the sealing element may be chargeable via the pressure device in a region of the sealing section.

The sealing device may further include a pressure device coupled to the sealing element, and the pressure device may be arranged at a side of the sealing element remote from the moving surface.

The sealing device can further include a pressure device coupled to the sealing element, and the sealing element may include a lug extending in a pivot direction. The lug can be chargeable via the pressure device.

The sealing device can further include a pressure device coupled to the sealing element and a spacer. A force transmission can take place from the pressure device onto the sealing element via the spacer. The space can be cambered at least one of a side facing the pressure device and a side facing the sealing element. Further, a guide can be structured and arranged to linearly guide the spacer.

The sealing device may further include a pressure device coupled to the sealing element. A force transmission can take place from the pressure device directly onto the sealing element.

The sealing device may further include at least one rinsing line, and the sealing element can be charged with cleansing agent via the at least one rinsing line. The sealing element may be permanently chargeable with cleansing agent during operation. The sealing element can be chargeable with cleansing agent only from time to time during operation.

According to still another feature of the present invention, the sealing element can include a sealing strip.

In accordance with another feature, the sealing strip can extend transversely to the running direction.

The sealing device can further include a side sealing of at least one zone of underpressure or overpressure adjoining a rotating jacket of one of a suction roll, a blow roll and a moving band.

The sealing device may be structured for sealing at least one pressure zone adjoining a rotation jacket of one of a suction roll and blow roll, and the sealing element can include a sealing strip extending at least substantially over an entire length of the roll.

The sealing device can be structured for sealing at least one inner zone of underpressure or overpressure adjoining an inner wall of a rotating jacket of one of a suction roll and a blow roll.

The sealing device may be structured for sealing at least one outer zone of underpressure or overpressure adjoining an outer wall of a rotating jacket of one of a suction roll and a blow roll.

The sealing device may be structured and arranged between one of a suction box and a blow box and a rotating jacket of one of a suction roll, blow roll, and a moving band.

In accordance with still yet another feature of the present invention, the ventilation section can include a run off surface having at least one of a substantially sawtooth and wavy shape surface arranged at an end of the rear. The sealing section may adjoin the ventilation section, the at least one of a substantially sawtooth and wavy shape surface can include a plurality of teeth extending in the running direction with grooves formed between adjacent teeth, and the grooves may be structured to flare open toward the end. The grooves can be structured to continuously increase in cross-section toward the end.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings. The invention will be described in more detail in the following with reference to embodiments and to the drawing, in which are shown.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
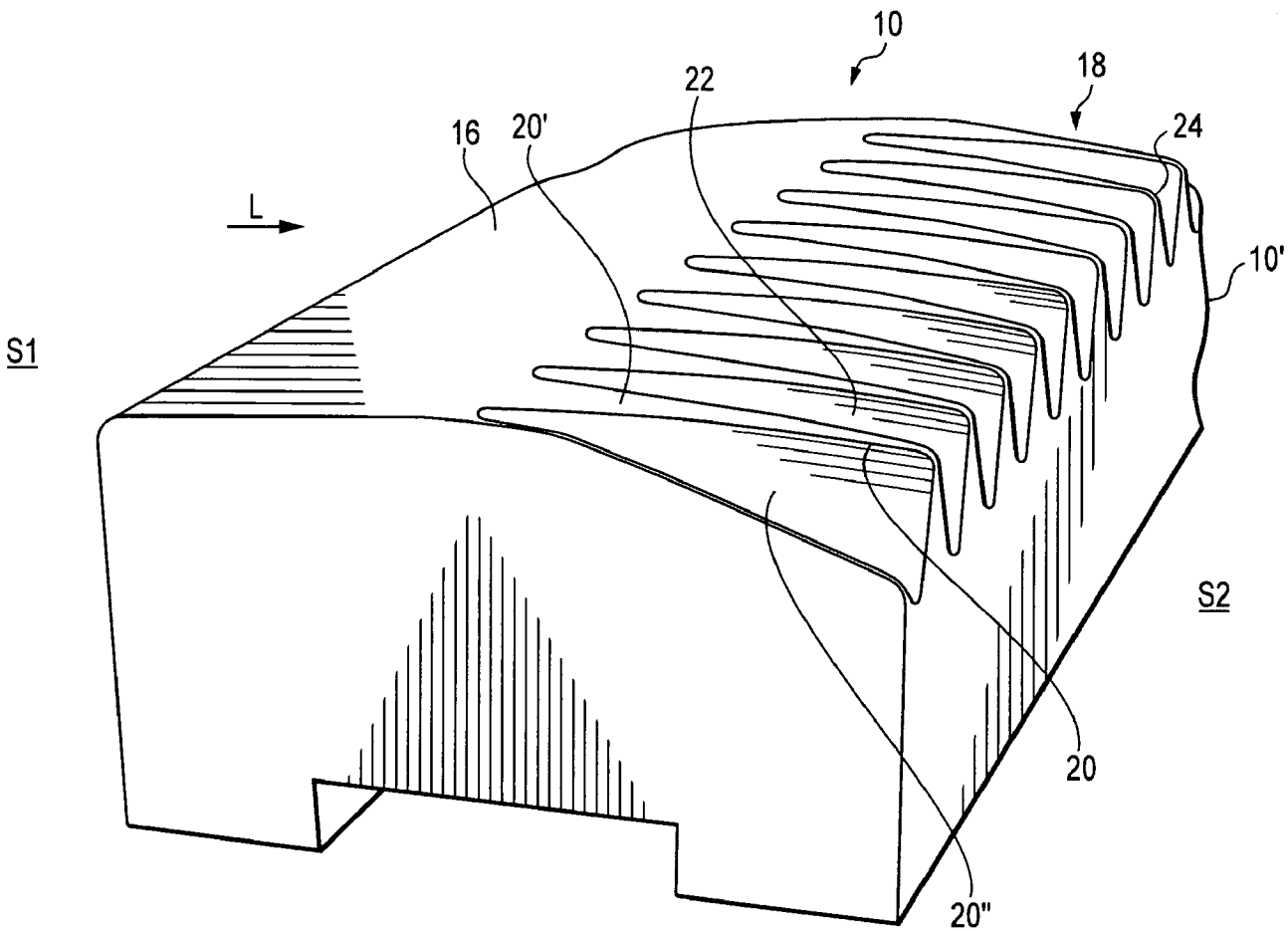
FIG. 1 illustrates a schematic perspective part illustration of an exemplary embodiment of a sealing element of a sealing device.
Figure 2:
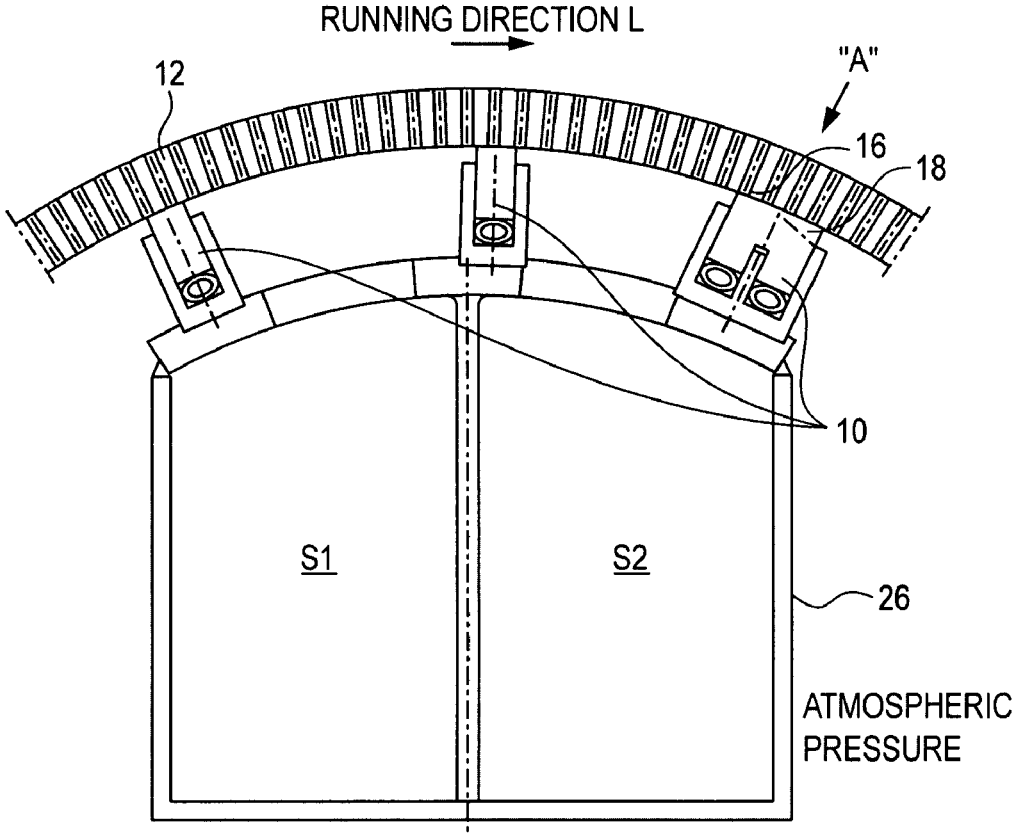
FIG. 2 illustrates a schematic cross-sectional illustration of a part of a suction roll provided with a suction box.
Figure 3:
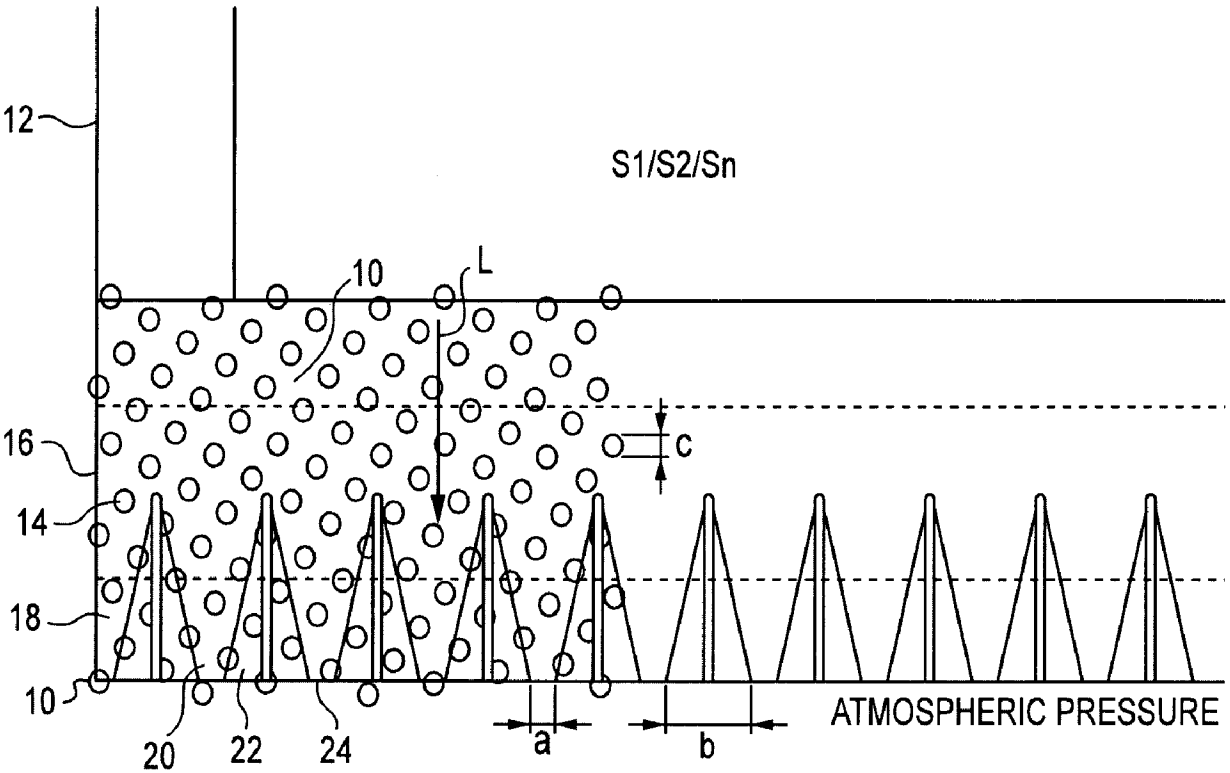
FIG. 3 illustrates a schematic plan view of the suction roll in accordance with FIG. 2 in the direction of the arrow A.

FIG. 1 shows, in a schematic perspective part illustration, a purely exemplary embodiment of a sealing element 10 of a sealing device which is arranged, for example, inside a suction roll of a paper making machine and which can cooperate with the inner wall of the roll jacket 12 (see also FIGS. 2 and 3). As many suction zones S1, S2, . . . , Sn of different pressure levels as desired can be sealed via such sealing elements 10. In accordance with FIG. 2, the roll jacket 12 is provided with openings 14, here, for example, suction openings.

In the present case, sealing element 10 interacts with a surface 12 formed by the jacket of a suction roll provided with openings 14. The direction of rotation of the suction roll and thus of moved surface 12 is specified as L in FIGS. 1 to 3.

In accordance with FIG. 1, sealing element 10 disposed or positioned opposite moved surface 12 (see FIGS. 2 and 3) includes a sealing section 16, which sealingly interacts with moved surface 12 and which is located at a front of sealing element 10, when viewed in running direction L. Sealing element 10 also includes an adjoining ventilation section 18 which is at the rear of sealing element 10, when viewed in running direction L. While sealing section 16 contacts moved surface 12 over its entire whole area and thus satisfies the related sealing function, ventilation section 18 of sealing element 10 is provided at its surface facing moved surface 12 with a plurality of teeth 20 extending in running direction L, which are arranged next to one another.

Teeth 20 extending in running direction L are designed and arranged such that grooves 22 formed therebetween open towards end 10', which is at the rear, and such that each grooves has a cross-section expanding continuously in running direction L so that an at least substantially sawtooth-like or trough-like (wavy) run off edge 24 results at rear end 10' of ventilation section 18. Teeth 20 each have a tooth crest 20' which narrows continuously in running direction L.

As can be recognized in particular with reference to FIG. 3, the width a of a respective tooth crest 20' is smaller than an orifice diameter c in the region of run off edge 24.

Tooth flanks 20" can have equal inclination in running direction L or can also in particular become continuously steeper. The groove depths can increase continuously in running direction L. Accordingly, a cross-section results for grooves 22 defined between teeth 20 which in each case expands continuously in running direction towards run off edge 24, with the grooves being able to have at least partly V-shaped cross-segments.

In the present embodiment, ventilation section 18 can be composed of the same material as sealing section 16, and may be made in one piece with sealing section 16 here.

Sealing element 10 is preferably formed by a sealing strip which extends transversely to running direction L. Such a sealing strip can, for example, extend over the whole roll length.

In the part illustration of a suction roll shown in FIG. 2 with an associated suction box 26, a plurality of sealing elements 10 can be recognized, of which at least one can be designed in the previously described manner.

Suction zone S1 can, for example, be an underpressure zone produced by an evacuated suction chamber. A different pressure can, for example, be present in suction zone S2 to suction zone S1.

Openings 14 of moved surface 12 or of the rotating roll jacket are therefore no longer opened abruptly, but constantly. Due to the constant opening of suction orifices or openings 14 at the inclined edges in running direction L and due to the continuous pressure reduction in openings 14 as a result of the decreasing grooves, the noise level produced for example by a suction roll is substantially reduced. The previously usual, so-called "suction roll whistling" is reduced to a minimum.

For instance, noise level measurements were carried out at a suction roll test bench under the following trial conditions:

outer roll diameter $D_a$=600 mm $v_{paper}$=420 m/mm (corresponds approximately to 244 rpm)

vacuum: 0.3 bar=3 m head

Noise levels were measured at a distance of approximately 1 mm and approximately 1.5 m above the ground.

A noise level resulted here without a vacuum of 80 dB (A) both for the wide standard sealing strip and for the toothed sealing strip. With vacuum, a noise level of 100 dB (A) resulted for the wide standard sealing strip, whereas a noise level of only 85 dB (A) was measured for the toothed sealing strip.

Figure 4:
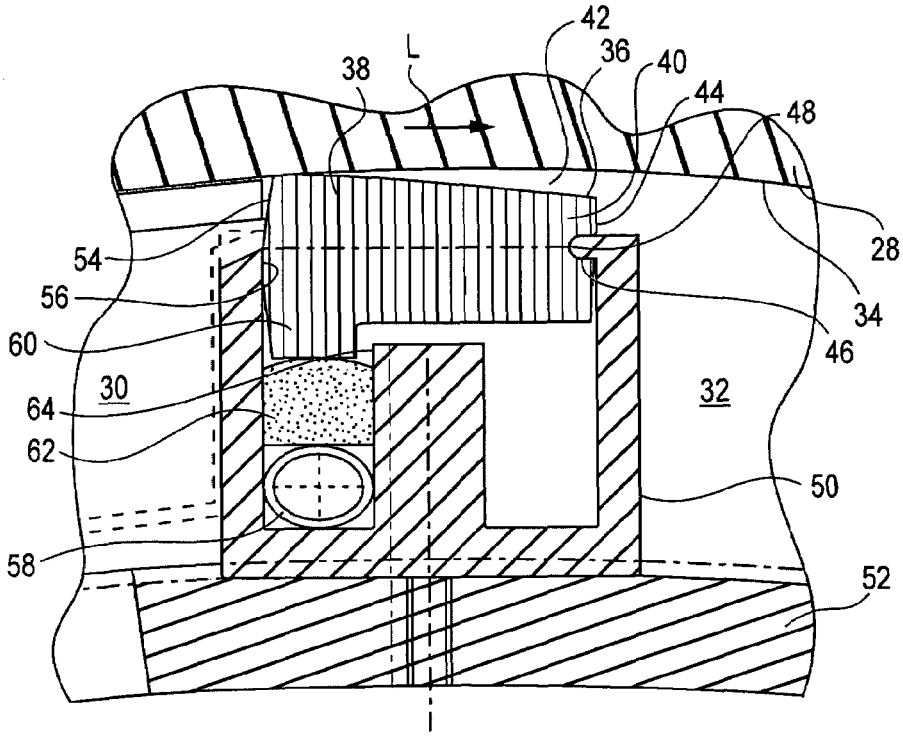
FIG. 4 illustrates a schematic cross-sectional illustration of another exemplary embodiment of a sealing device having a pivotally mounted sealing element, with the initial installation state being shown.

FIG. 4 shows in a schematic cross-sectional representation another exemplary embodiment of a sealing device which is arranged, for example, inside a suction roll of a paper making machine and can interact with an inner wall of a roll jacket 28. Such a sealing device can therefore, for example, be provided for sealing at least one zone of under pressure or suction 30. Roll jacket 28 is, for example, provided with suction openings (not shown). Moved surface 34 is also again formed by the inner surface of roll jacket 28 in the present case. Rear zone 32 in running direction L of moved surface 34 has a different pressure level to front zone 30 and can, for example, be in communication with the atmosphere.

In the present case, the sealing device again interacts with moved surface 34 formed by the jacket of a suction roll and provided with openings.

In accordance with FIG. 4, the sealing device again includes a sealing element 36 which is disposed opposite moved surface 34 and which can in particular be a sealing strip extending transversely to running direction L. This sealing element 36 is in the present case, however, pivotally mounted.

In this connection, sealing element 36 can be pivoted to achieve the sealing function into an operating position visible from FIG. 4, in which a sealing section 38 of sealing element 36, which is at the front observed in running direction L, sealingly contacts moved surface 34. However, a gap 42 remains between a ventilating section 40 of sealing element 36, which adjoins front sealing section 38 and which is at the rear when viewed in running direction L, moved surface 34.

Sealing element 36 is pivotal about an axis extending transversely to running direction L. The corresponding pivot mounting, which can in particular be a rocker bearing, is provided in the region of rear end face 44 of sealing element 36.

As can be recognized with reference to FIG. 4, the pivot mounting includes a fixed bearing element 46 which engages into a groove 48 provided in rear end face 44 of sealing element 36 and extending transversely to running direction L. Bearing element 46 can, for example, be provided at or secured to a holder 50 which is secured, for example, to a carrier 52.

Holder 50 is open towards moved surface 34. Sealing element 36 lies partly inside and partly outside this holder 50, with a fixed guide surface 56 formed by holder 50 being provided in the region of front end face 54 of sealing element 36 and admittedly permitting a pivot movement of sealing element 36. Moreover, fixed guide surface 56 prevents sealing element 34 from moving away from fixed bearing element 46 so as to maintain the pivot bearing. Therefore, it is excluded that bearing element 46 comes out of engagement with groove 48.

As can be recognized with reference to FIG. 4, front end face 54 of sealing element 36 has a curved extend observed in the pivot plane, i.e., in the sheet plane. Fixed guide surface 56 is planar in the present case. However, it is also contemplated that fixed guide surface 56 can be curved (see, e.g., FIG. 8).

Gap 42 expands in running direction L such that the sealing edge, which is at the rear considered in running direction L, is clearly offset from moved surface 34. In the present case, sealing element 36 also has in particular a thickness which reduces in running direction L.

Sealing element 36 can be loaded into the represented operating position by pressing device 58, in the present case by at least one pressure hose, with sealing element 36 being loadable during operation by these pressure device 58, for example, permanently into its operating position. Generally, however, it is also possible for sealing element 36 to be held in its respective operating position, for example, by a kind of friction clamping between sealing element 36 and, for example, holder 50, which produces the advantage that pressure device 58, which can be formed, for example, by at least one pressure hose and/or the like, does not have to be constantly activated. A respective pressure hose therefore does not have to be constantly under pressure. Such a friction clamping, however, not compulsory.

As can be seen with reference to FIG. 4, sealing element 36 is charged in the region of front sealing section 38 by pressure device 58, with pressure device 58 being arranged at the side of sealing element 36 remote from moved surface 34.

In the present case, sealing element 36 includes a lug 60 which generally extends in the pivot direction and which is charged by pressure device 58.

The force transmission from pressure device 58 onto sealing element 36 can take place via a spacer 62. Spacer 62 can be cambered in each case at the side facing pressure device 58 and the side facing sealing element 36. Spacer element 62 serves, for example, for the protection of pressure device 58, i.e. for example the pressure hose or the like.

As can be seen with reference to FIG. 4, spacer 62 is preferably guided in a linear manner in a guide 64 formed in holder 50.

With a respective wear of front sealing section 38 contacting moved surface 34, sealing element 36 can be correspondingly readjusted by pressure device 58. If sealing element 36 is permanently loaded by pressure device 58, i.e. if the pressure hose is continuously under pressure, then a continuous readjustment takes place. Generally, however, a, for example, periodic readjustment is also possible in which pressure device 58 or the pressure hose are charged correspondingly periodically.

Figure 5:
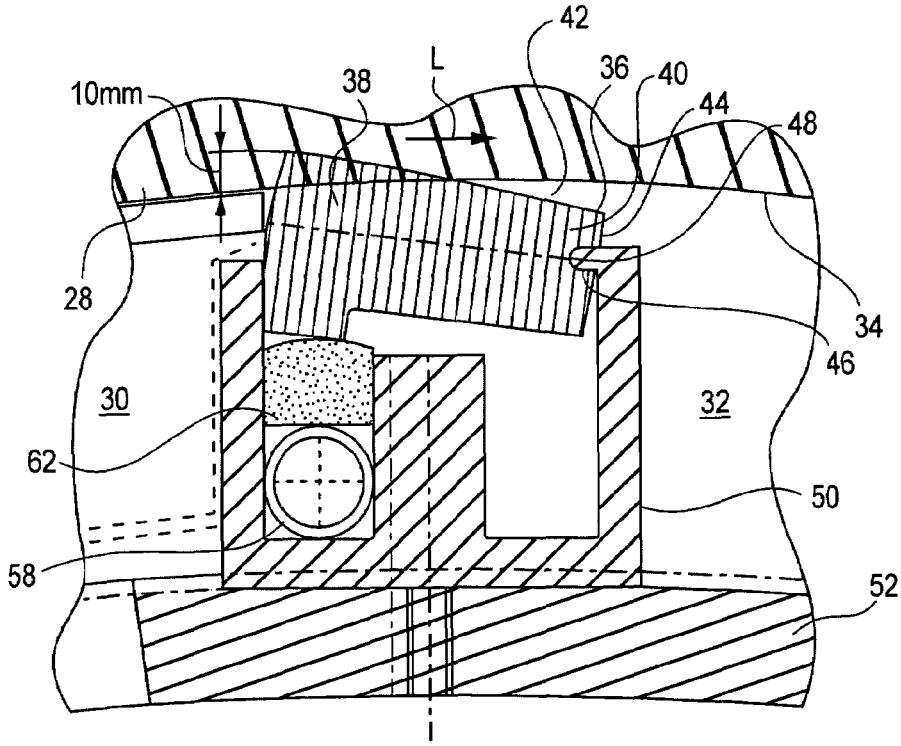
FIG. 5 illustrates a schematic cross-sectional representation of the sealing device depicted in FIG. 4 in a state resulting from wear of the sealing element of approximately 10 mm.

FIG. 5 shows the sealing device in accordance with FIG. 4 in a state such as results, with wear of sealing element 36 of, for example, approximately 10 mm. Sealing element 36 was readjusted here by a corresponding angle by pressure device 58.

Figure 6:
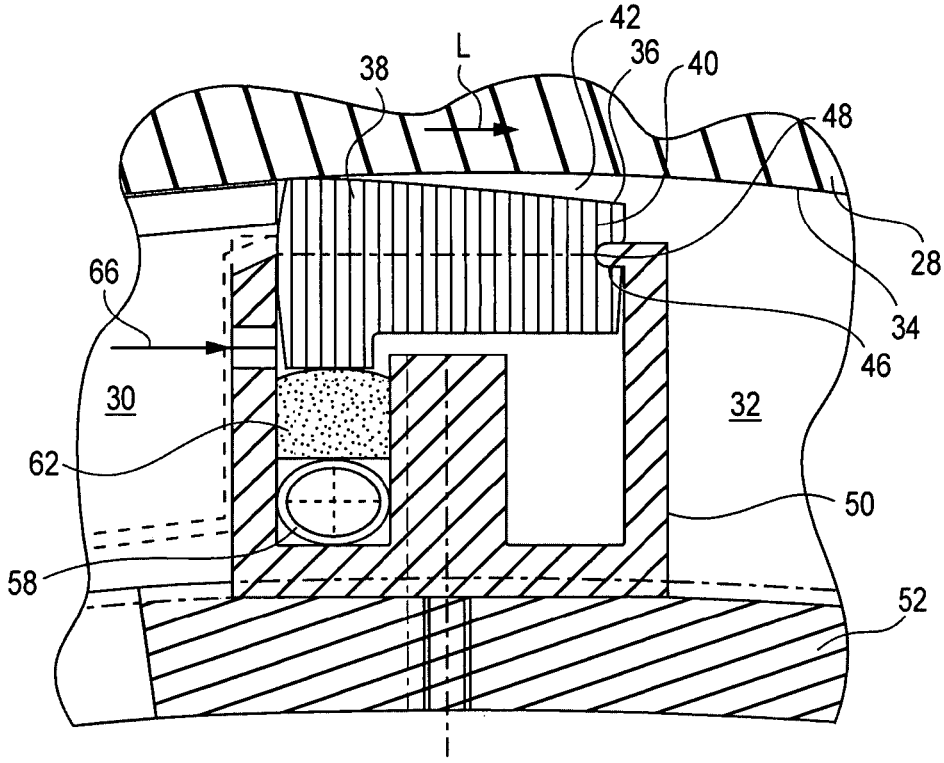
FIG. 6 illustrates a sealing device comparable to that depicted in FIG. 4 with associated rinsing line.

FIG. 6 shows an embodiment of the sealing device comparable with the embodiment in accordance with FIG. 4, in which sealing element 36 is, however, chargeable with cleansing agent via at least one rinsing line 66, with the cleansing agent, for example, entering into the region of sealing element 36, in whose region a corresponding connection possibility exists, via an opening 66 provided in holder 50. Such a rinsing line is, however, not compulsory, but is to be considered an alternative possibility.

Sealing element 36 can be charged with cleansing agent permanently or only from time to time, e.g. periodically, during operation.

In another respect, the sealing apparatus can again have at least substantially the same design as that of FIG. 4. Mutually corresponding parts are assigned the same reference numerals.

Figure 7:
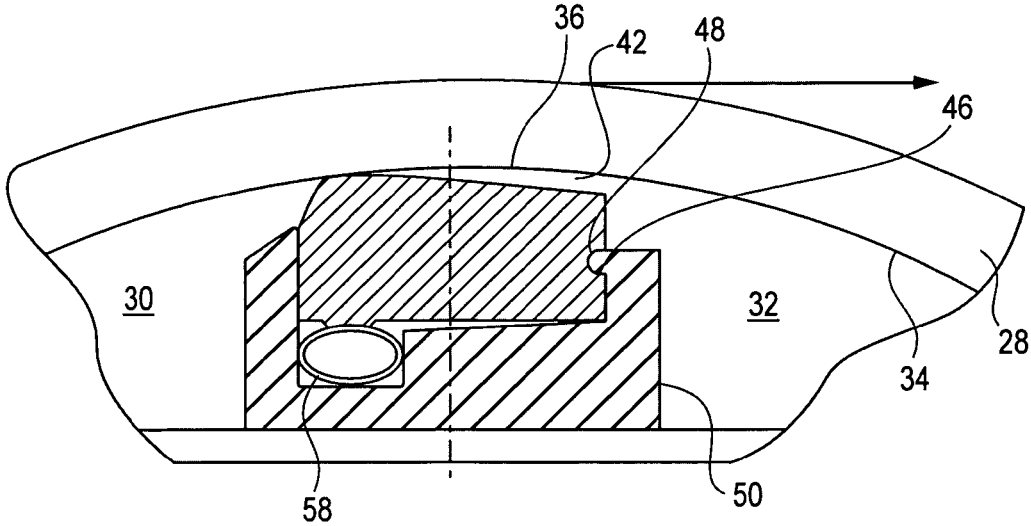
FIG. 7 illustrates a sealing device comparable to that depicted in FIG. 4 without a spacer.

FIG. 7 shows an illustration of a sealing device comparable to the embodiment of FIG. 4, but in which spacer 62 is omitted. In the present case, therefore, the force is transmitted from pressure device 58, that is for example a pressure hose or the like, directly onto sealing element 36.

In another respect, the sealing device can, for example, be again at least substantially designed as that in accordance with FIG. 4. Mutually corresponding parts are again assigned the same reference numerals. Generally, however, a charging of sealing element 36 with cleansing again is again also possible here, as is illustrated, for example, in FIG. 6.

Figure 8:
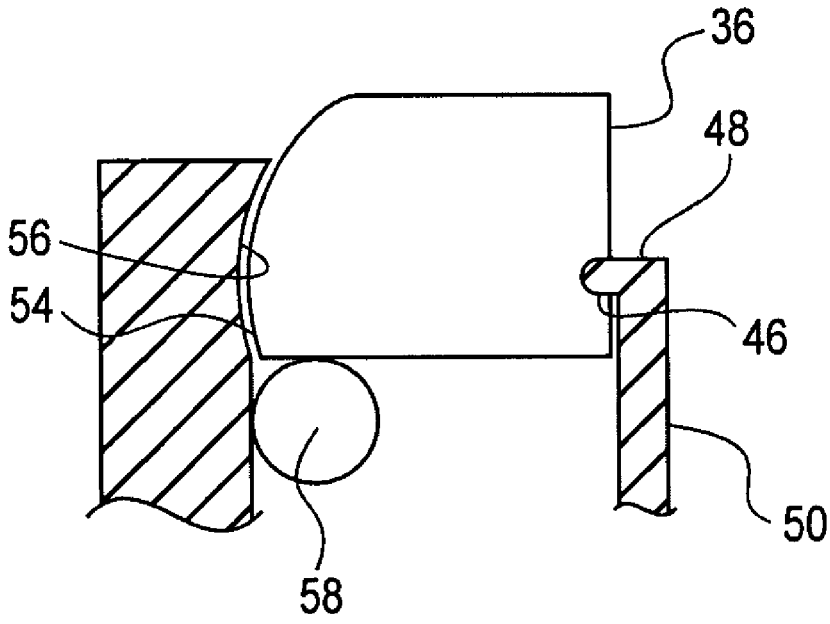
FIG. 8 illustrates a sealing device comparable to that depicted in FIG. 7 with a fixed guide surface that is curved.

FIG. 8 shows, in a schematic part illustration, a sealing device comparable to that of FIG. 7, in which fixed guide surface 56 is also curved. In another respect, this embodiment can again have at least substantially the same design as, for example, the embodiment shown in FIG. 7. Mutually corresponding parts are assigned the same reference numerals. Generally, the fixed guide surface can also be alternatively planar or curved in the other embodiments.

In the embodiments illustrated in FIGS. 4 to 8, sealing element 36 is preferably designed without teeth. Generally, however, a version with teeth is also possible in these cases, as was in particular described in connection with FIGS. 1 to 3.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

REFERENCE NUMERAL LIST

10 sealing element
10' rear end
12 roll jacket, moved surface
14 opening
16 sealing section
18 ventilation section
20 tooth
20' tooth crest
20" tooth flank
22 groove
24 run off edge
26 suction box
28 roll jacket
30 suction zone
32 zone
34 moved surface
36 sealing element
38 front sealing section
40 rear ventilation section
42 gap
44 rear end face
46 bearing element
48 groove
50 holder
52 carrier
54 front end face
56 guide surface
58 pressure means, pressure hose
60 lug
62 spacer
64 guide
66 opening
a crest width
b maximum groove width
L running direction of the moved surface
S1 suction zone
S2 suction zone

The invention claimed is:

1. A sealing device for sealing at least one zone of underpressure or overpressure adjoining a moving surface, comprising:

at least one sealing element, positionable opposite the moving surface to form a front and a rear, with respect to a surface running direction, comprising a sealing section located at said front and a ventilation section located at said rear;

said sealing section being structured to sealingly interact with the moving surface; and said ventilation section being structured and arranged to form a gap with the moving surface that widens in the surface running direction, wherein said sealing element is pivotally mounted at an end of said ventilation section.

2. The sealing device in accordance with claim 1, wherein said sealing section adjoins said ventilation section.

3. The sealing device in accordance with claim 2, wherein said ventilation section is structured to continuously decrease in cross-section away from said sealing section.

4. The sealing device in accordance with claim 3, wherein the moving surface is arranged in a paper making machine.

5. The sealing device in accordance with claim 2, wherein said gap has a continuously increasing depth in the surface running direction.

6. The sealing device in accordance with claim 1, wherein said sealing section and said ventilation section are composed of a same material.

7. The sealing device in accordance with claim 6, wherein said sealing section and said ventilation section are formed as a single piece.

8. The sealing device in accordance with claim 1, wherein said sealing section and said ventilation section are composed of different materials.

9. The sealing device in accordance with claim 8, wherein said sealing section and said ventilation section are separately formed and secured together.

10. The sealing device in accordance with claim 1, wherein said ventilation section is composed of a porous sound-absorbing plastic.

11. The sealing device in accordance with claim 1, wherein said sealing section is composed of at least one of rubber graphite, polyethylene, and thermosetting plastic.

12. The sealing device in accordance with claim 11, wherein said polyethylene comprises thermoplastic UHMW and said thermosetting plastic comprises phenolic resin.

13. The sealing device in accordance with claim 1, wherein said sealing element comprises a sealing strip.

14. The sealing device in accordance with claim 13, wherein said sealing strip extends transversely to the running direction.

15. A sealing device for sealing at least one zone of underpressure or overpressure adjoining a moved surface, comprising:

at least one sealing element, positionable opposite the moving surface to form a front and a rear, with respect to a surface running direction, comprising a sealing section located at said front and a ventilation section located at said rear; and said at least one sealing element being pivotably mounted at an end of said ventilation section to pivot relative to the moving surface to position said at least one sealing element into an operating position, wherein, in said operating position, said sealing section is in sealing contact with the moving surface and a gap is formed between the ventilation section and the moving surface, and wherein said gap increases in the running direction.

16. A sealing device for sealing at least one zone of underpressure or overpressure adjoining a moved surface, comprising:

at least one sealing element, positionable opposite the moving surface to form a front and a rear, with respect to a surface running direction, comprising a sealing section located at said front and a ventilation section located at said rear;

said at least one sealing element being pivotably mounted at an end of said ventilation section to pivot relative to the moving surface to position said at least one sealing element into an operating position; and a pressure device coupled to said sealing element, wherein, in said operating position, said sealing section is in sealing contact with the moving surface and a gap is formed between the ventilation section and the moving surface, wherein said sealing element is loadable into said operating position by said pressure device, and wherein said pressure device comprises a pressure hose.

17. A sealing device for sealing at least one zone of underpressure or overpressure adjoining a moved surface, comprising:

at least one sealing element, positionable opposite the moving surface to form a front and a rear, with respect to a surface running direction, comprising a sealing section located at said front and a ventilation section located at said rear;

said at least one sealing element being pivotably mounted at an end of said ventilation section to pivot relative to the moving surface to position said at least one sealing element into an operating position; and a pressure device coupled to said sealing element, wherein, in said operating position, said sealing section is in sealing contact with the moving surface and a gap is formed between the ventilation section and the moving surface, and wherein said sealing element comprises includes a lug extending in a pivot direction, said lug being chargeable via said pressure device.

18. A sealing device for sealing at least one zone of underpressure or overpressure adjoining a moved surface, comprising:

at least one sealing element, positionable opposite the moving surface to form a front and a rear, with respect to a surface running direction, comprising a sealing section located at said front and a ventilation section located at said rear;

said at least one sealing element being pivotably mounted at an end of said ventilation section to pivot relative to the moving surface to position said at least one sealing element into an operating position; and a pressure device coupled to said sealing element and a spacer, wherein, in said operating position, said sealing section is in sealing contact with the moving surface and a gap is formed between the ventilation section and the moving surface, and wherein a force transmission takes place from said pressure device onto said sealing element via said spacer.

19. The sealing device in accordance with claim 18, said spacer being cambered at least one of a side facing said pressure device and a side facing said sealing element.

20. The sealing device in accordance with claim 19, further comprising a guide structured and arranged to linearly guide said spacer.

* * * * *